US005099535A

United States Patent [19]

Chauvier et al.

[11] Patent Number: 5,099,535

[45] Date of Patent: Mar. 31, 1992

[54] CLEANER FOR SUBMERGED SURFACES

[75] Inventors: Daniel J. V. D. Chauvier, 14 Portside, Yacht Club, 17th Causeway, Fort Lauderdale, Fla. 33304; Peter Woodman, Transvaal, South Africa; Benjamin J. Krywick, Plantation, Fla.

[73] Assignee: Daniel J. D. Chauvier, Fort Lauderdale, Fla.

[21] Appl. No.: 345,483

[22] Filed: May 1, 1989

[30] Foreign Application Priority Data

May 3, 1988 [ZA] South Africa ..... 88/1121

[51] Int. Cl.[5] ..... E04H 3/20

[52] U.S. Cl. ..... 15/1.7

[58] Field of Search ..... 15/1.7, 345

[56] References Cited

U.S. PATENT DOCUMENTS 3,108,298 10/1963 Gelinas ..... 15/1.7
3,229,315 1/1966 Watson ..... 15/1.7
3,972,339 8/1976 Henkin ..... 15/1.7
4,558,479 12/1985 Greskovics ..... 15/1.7
4,560,418 12/1985 Raubenheimer ..... 15/1.7
4,768,532 9/1988 Johnson ..... 15/1.7
4,920,599 5/1990 Rief ..... 15/1.7

*Primary Examiner*—Edward L. Roberts
*Attorney, Agent, or Firm*—Ladas & Parry

[57] ABSTRACT

A cleaner for a submerged surface (11) comprises a body (15) defining a suction passage (16) and pressure passage (17) therethrough. Suction passage (16) extends between inlet (18) and outlet (19) in the body and is connectable to the inlet of a filtration system by flexible hose (13). Pressure passage (17) extends between inlet (20) and outlet (21). Inlet (20) is connectable to an outlet of the system. Drive means in the form of a water turbine (22) is located in passage (17). Water flow under pressure through passage (17) drives turbine (22) which in turn drives hind wheels (23) to displace the apparatus over surface (11), while debris or the like is sucked up through the suction passage (16).

10 Claims, 5 Drawing Sheets

CLEANER FOR SUBMERGED SURFACES

Figure 1:
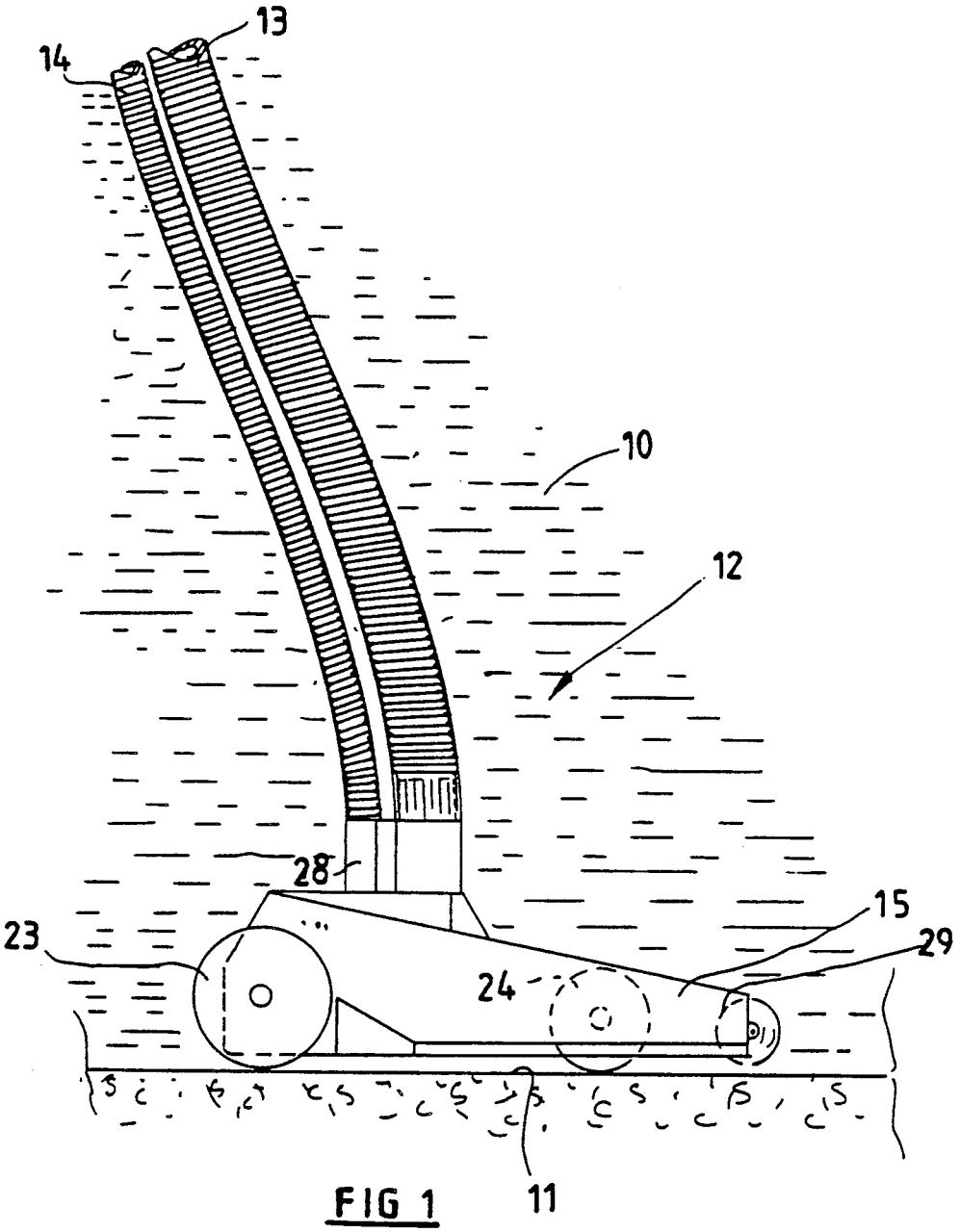

This invention relates to cleaners for submerged surfaces and in particular to automatic swimming pool cleaners.

According to the invention there is provided a cleaner for a surface submerged in a liquid which is connectable to a filtration system including a pump having an inlet and an outlet, the cleaner defining separate first and second flow passages therethrough; the first passage being a suction passage extending between a first inlet to the cleaner and a first outlet therefrom, the outlet being connectable to the inlet of the system; the second passage being a pressure passage extending between a second inlet to the cleaner connectable to the outlet of the system and a second outlet from the cleaner; the cleaner comprising drive means for displacing the cleaner over the surface to be cleaned under the influence of liquid flow through at least one of the passages.

In the preferred embodiment the cleaner comprises a body defining the suction and pressure passage therethrough; and surface engageable wheels mounted on the body to support the body such that, in use, the inlet to the suction passage is spaced from the surface; the drive means being drivingly connected to at least some of the wheels thereby to displace the cleaner over the surface to be cleaned.

The drive means may comprise a water turbine extending at least partially into the pressure passage, the turbine being connected to the wheels by a drive train.

The drive train may comprise a first pulley on an output shaft of the turbine, a second pulley on a common axle extending between two driving wheels and a belt between the two pulleys.

The cleaner may also comprise a pivotable surface engageable wheel mounted on an axle therefor, the wheel being pivotable about an axis substantially normal to the surface to be cleaned and intersecting the said axle. The wheel may be pivoted by actuation means driven by the aforesaid drive means.

The actuation means may comprise a belt and pulley arrangement connected to the drive means and a cam and follower arrangement, the cam being driven by the belt and pulley arrangement and the follower being connected to the axle of the pivotable wheel by at least one arm.

In some embodiments of the cleaner according to the invention the pressure passage may diverge into at least one branch passage in the body. Fluid flow regulating means driven by the drive means may be provided for intermittently diverging liquid flow through one or more of the branch passages.

One branch passage may extend between the pressure passage and an outlet in the bottom of the body, a nozzle may be provided at the said outlet so that a jet of liquid emitting through the outlet when liquid is diverged through the branch passage provides a thrust for lifting and displacing the cleaner.

The cleaner may comprise weight or ballast material in the body towards the bottom thereof and buoyancy members towards the top thereof.

A further branch passage may extend between the second flow passage and an outlet defined in the body so that a jet of liquid emitting through this outlet may dislodge debris on the surface to be cleaned.

In some embodiments of the cleaner according to the invention there may be provided means for sweeping and/or scrubbing and/or brushing the surface to be cleaned which are connectable to the body to be driven by the drive means.

The cleaner according to the invention may comprise a bumper comprising a ball mounted for rotation in a socket defined in the body, the ball extending outwardly beyond the periphery of the body to fend off submerged obstacles.

The cleaner may also comprise a hose bridge mounted at the top of the body. Flexible hoses for connecting the suction and pressure passages of the cleaner to the inlet and outlet of the system are connectable to the cleaner via the bridge.

In another possible embodiment of the cleaner according to the invention the drive means may comprise an oscillatable member provided in the suction passage, the oscillatable member being displaceable between two terminal positions under the influence of liquid flow through the passage thereby intermittently to vary the rate of liquid flow through the passage.

A nozzle may be provided at the outlet of the pressure passage so that a jet of liquid emitting through the nozzle may serve to drive the cleaner and/or to dislodge debris from the surface to be cleaned.

According to the another aspect of the invention a method of cleaning a surface submerged in a liquid comprises the steps of:

- providing a cleaner defining separate suction and pressure passages therethrough;
- connecting the suction passage to a suction inlet of a filtration system including a pump and connecting the pressure passage to an outlet of the system;
- causing liquid to flow under pressure through the pressure passage thereby to actuate drive means to cause displacement of the cleaner over the surface to be cleaned; and
- causing liquid to flow under suction through the cleaner to the system thereby to suck up debris or the like from the surface to be cleaned.

Figure 2:
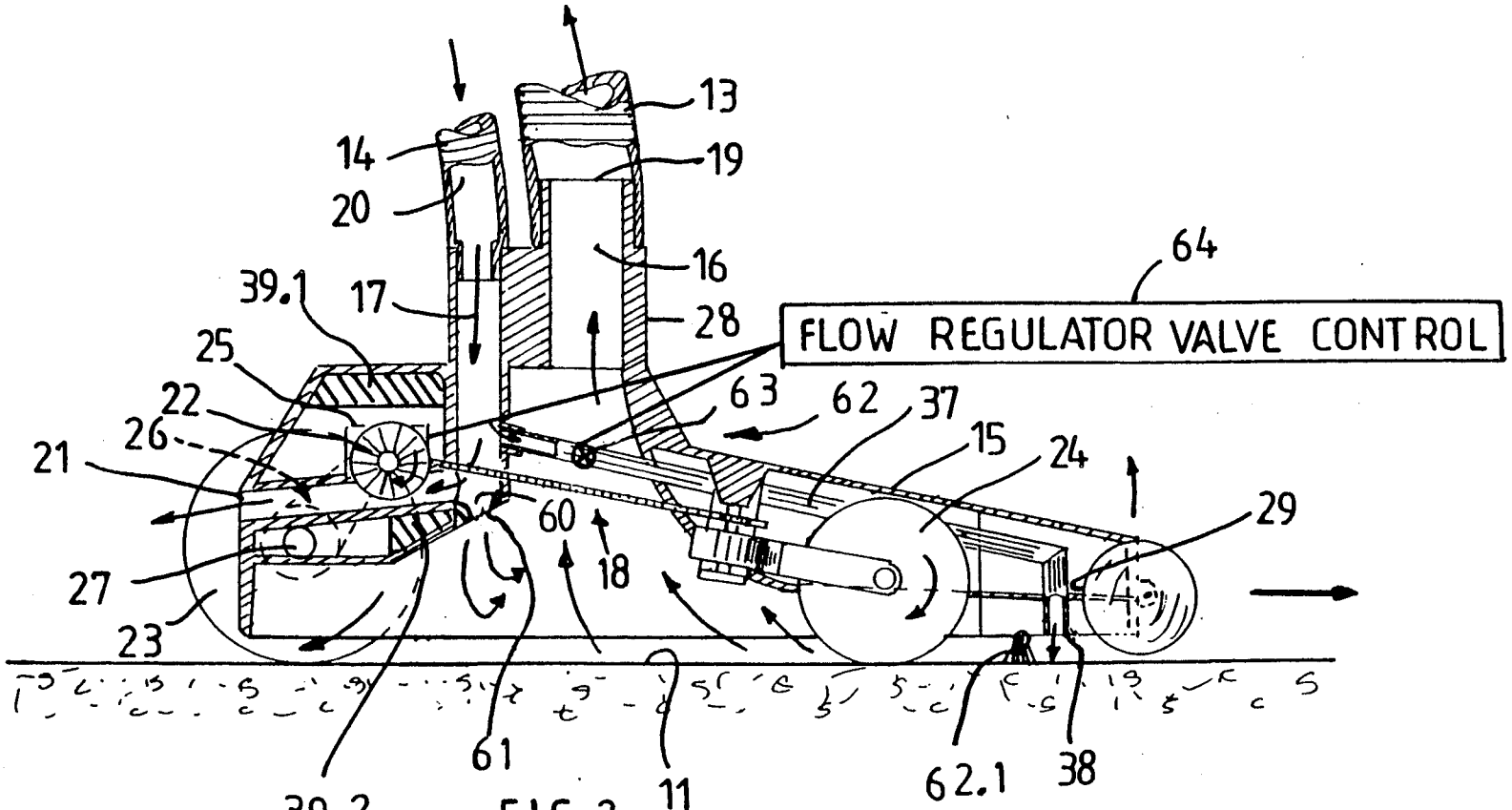
Figure 3:
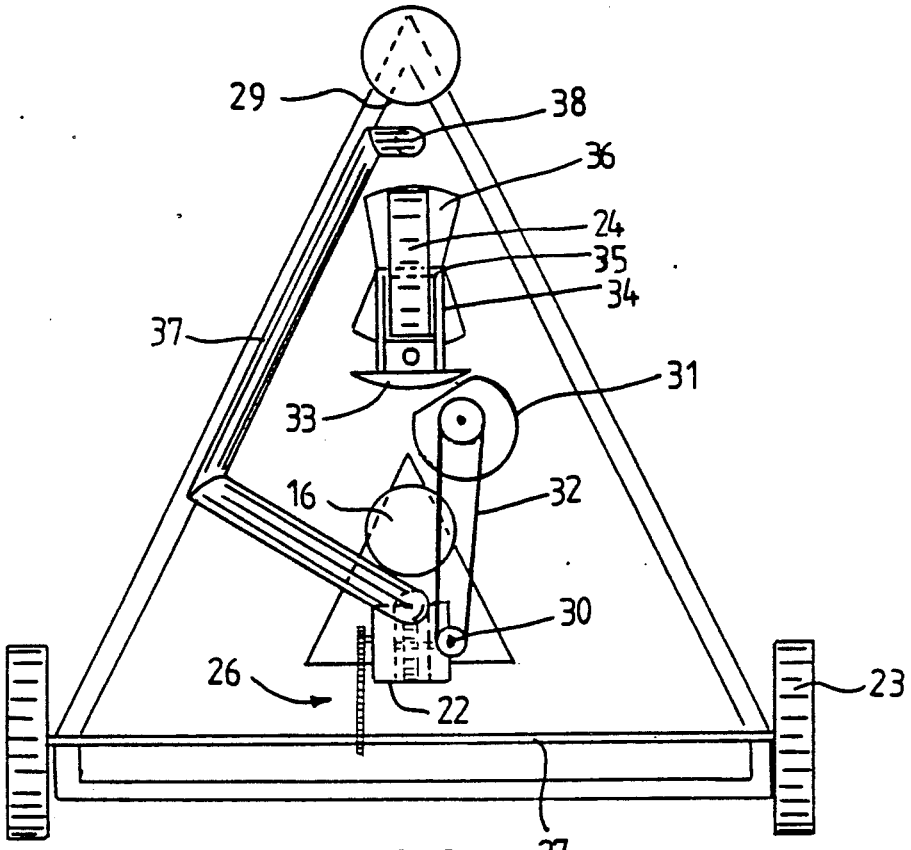

The invention will now be described, by way of example only, with reference to the accompanying diagrams wherein:

FIG. 1: is a diagrammatic side view of a preferred embodiment of a cleaner for submerged surfaces according to the invention;

FIG. 2: is a side view in section of the cleaner in FIG. 1;

FIG. 3: is a sectional view in plan of the cleaner in FIG. 1; and

Figure 4:
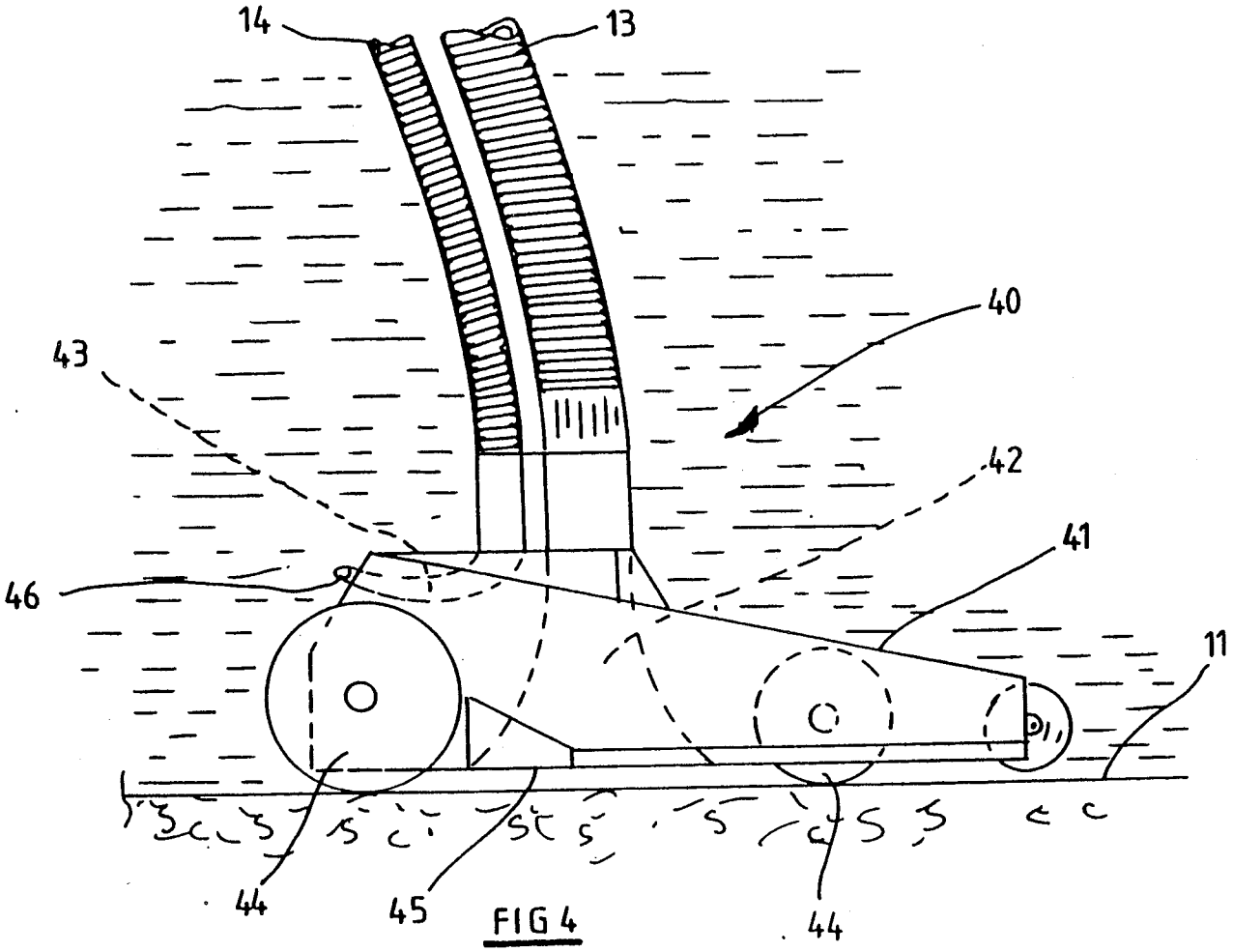
Figure 5:
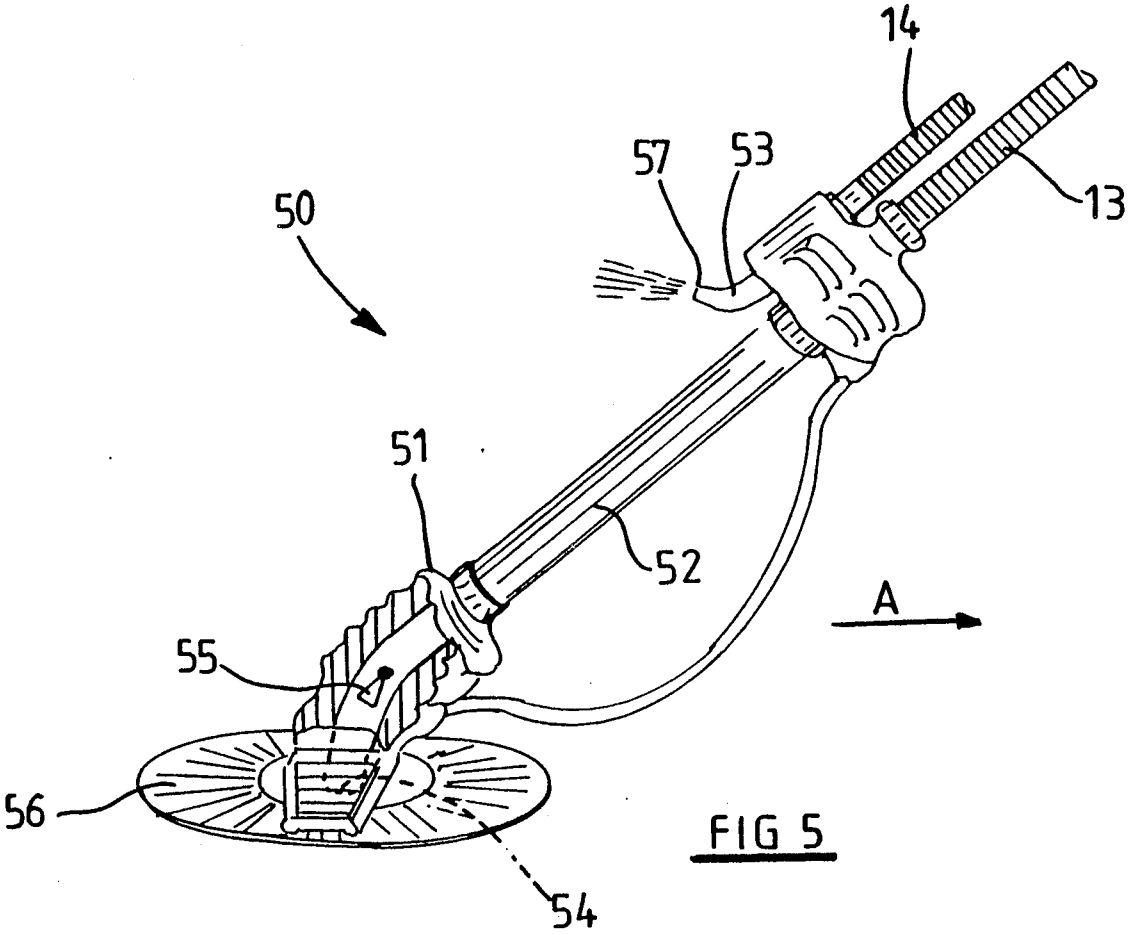

FIG. 4: is a diagrammatic side view of another possible embodiment of the cleaner according to the invention; and FIG. 5: is a similar view of yet another possible embodiment of the cleaner according to the invention.

A preferred embodiment of a cleaner for surfaces submerged in water 10, such as the floor 11 of a swimming pool, is designated by the reference numeral 12 in FIGS. 1 to 3. The cleaner 12 is adapted to be connected to a filtration system (not shown) including a pump (also not shown), by a suction hose 13 leading to an inlet of the pump and a return hose 14 extending from an outlet of the pump. The suction and return hoses are of the well known longitudinally and transversely flexible kind.

Referring to FIGS. 1 and 2 the cleaner comprises a body 15 defining first and second flow passages 16 and 17 therethrough. The first passage 16 is a suction passage extending between an inlet 18 thereto defined in a peripheral region of the body 15 and an outlet 19 therefrom which is connectable to the suction hose 13. The second flow passage 17 is a pressure passage extending between an inlet 20 thereto which is connectable to the return hose 14 and an outlet 21 therefrom. The cleaner 12 further comprises means, in the form of a turbine 22, for driving the cleaner under the influence of water flow under pressure through pressure passage 17.

As is best shown in FIG. 2, hind surface-engageable wheels 23 and front surface engagable wheel 24 serve to support body 15 such that, in use, the inlet 18 to suction passage 16 is spaced from the surface 11. Turbine 22 is located in a chamber 25 and is drivingly connected to the hind wheels 23 via a belt and pulley arrangement 26 driving common axle 27 as shown in FIGS. 2 and 3.

As shown in FIG. 2, inlet 18 to suction passage 16 is held in a position suitably spaced from surface 11 by wheels 23 and 24 so that debris or the like on the surface may be sucked up through the inlet 18 and conveyed to the filtration system via flow passage 16 and suction hose 13. A branch passage 60 from the flow passage 16 to an outlet 61 from the branch passage provides a jet of the liquid for dislodging surface debris to be sucked as described above. A brush 62*a* for sweeping the surface may aid this, too.

Filtered water is returned by the pump via return hose 14, through pressure flow passage 17 and past turbine 22 to drive the latter and to displace the cleaner before being discharged into the pool through outlet 21.

The hoses 13 and 14 are connected to the cleaner body 15 via a hose bridge 28. A nose bumper in the form of a ball mounted for rotation in a socket 29 defined in body 15 is provided at the nose end of the cleaner and serves to fend off submerged obstacles, such as steps or the like (not shown).

Referring next to FIGS. 2 and 3, front or steering wheel 24 is connected to turbine 22 via a random steering mechanism including a pulley arrangement 30 driving cam 31 via belt 32. Cam follower 33 having arms 34 is connected to front wheel axle 35. This turbine driven steering mechanism, in use, is operative to pivot front wheel 24 in slot 36 defined in body 15 about an axis normal to surface 11 and intersecting axle 35.

The cleaner also defines another branch passage 37 extending between second flow passage 17 and an outlet 38 defined in the bottom of body 15, between front wheel 24 and nose bumper 29. A liquid flow regulator at 62 has a control 64 driven by turbine 22 to actuate a valve 63 intermittently to open and close this branch passage 37 so that water under pressure is intermittently allowed to flow through the passage 37 and to be emitted through outlet 38. This jet of water provides a lifting thrust for displacing the cleaner 12, from a position wherein it may have become stuck, to another position from where it may continue along its randomly steered path through the pool.

As shown in FIG. 2, weight or ballast material 39.2 is located in the body towards the bottom thereof while buoyancy members 39.1 are mounted in the body towards the top thereof. It will be appreciated that these members will ensure stability of the cleaner in use and also that it will land on its wheels after having been lifted and displaced as hereabove described.

Thus, in use, water including debris or the like is sucked up from the surface 11 and conveyed to the filtration system via inlet 18, flow passage 16 and suction hose 13. Filtered water is pumped through the return hose 14, pressure flow passage 17 and outlet 21 into the pool. The water under pressure drives turbine 22 which in turn drives the hind driving wheels 23 as well as the steering mechanism for front wheel 24. Furthermore, the liquid flow regulating means (not shown), which is also driven by turbine 22, intermittently allows water in flow passage 17 to flow through branch passage 37 and to be emitted through outlet 38. This jet of water provides a thrust for lifting the cleaner over an obstacle it may have encountered in the meantime and to displace it to another position away from the obstacle where it may continue to be driven along its randomly steered path by the hind wheels 23 that are driven by turbine 22.

In FIG. 4 there is shown another possible embodiment of the cleaner according to the invention. This cleaner is designated by the reference numeral 40.

Cleaner 40 comprises a suction head 41, a suction passage 42 connectable to an inlet of the filtration system (not shown) and a pressure passage 43 connectable to an outlet of the filtration system. Suction head 41 is supported on the surface 11 to be cleaned by means of wheels 44. Suction passage 42 defines an inlet 45 close to surface 11.

At the outlet of the pressure passage 43 there is provided a nozzle 46. Water under pressure emitted through this nozzle causes displacement of the cleaner over surface 11, while debris or the like is sucked up through inlet 45 and passage 42.

In FIG. 5 there is shown yet another possible embodiment of the cleaner according to the invention designated generally by the reference numberal 50. Also this cleaner comprises a cleaner head 51, a suction passage 52 connectable to an inlet of the filtration system (not shown) and a pressure passage 53 connectable to an outlet of the filtration system. Suction head 51 defines an inlet 54 to suction passage 52 in a peripheral region thereof. A flapper valve 55 is mounted in passage 52. This valve, in use, oscillates between two terminal positions in the head as a result of liquid flow past it. The oscillating valve therefore causes a periodic variation in water flow through the suction passage 52 which in turn imparts kinetic energy to the head 51 to displace it over surface 11 in the direction of arrow A. A flexible sealing flange 56 is provided about inlet 54 and relief openings (not shown) are provided in flange 56 to communicate with suction passage 52.

At the outlet of pressure passage 53 there is provided a nozzle 57. Water under pressure emitted through this nozzle will assist in displacing the cleaner over surface 11.

It will be appreciated that there are many variations in detail on the cleaner according to the invention without departing from the scope and spirit of the appended claims.

We claim:

1. A cleaner for a surface submerged in a liquid which is connectable to a filtration system including a pump and having an inlet and an outlet for the liquid, the cleaner comprising a body defining separate suction and pressure flow passages therethrough; the suction passage extending between a first inlet to the body and a first outlet from the body, the first outlet being connectable to an inlet of a filtration system, so that, in use, liquid entraining debris may be sucked through the suction passage to the filtration system; the pressure passage extending between a second inlet to the body, and a second outlet from the body for, in use, returning under pressure the liquid sucked through the suction passage and filtration system, the second inlet being connectable to an outlet of the filtration system; surface engageable wheels mounted on the body to support the body such that the inlet to the suction passage is spaced from the surface; and drive means comprising at least one of said surface-engageable wheels and a turbine extending at least partially into the pressure passage, the turbine being drivingly connected to the at least one surface-engageable wheels by a drive train, in use, to displace the cleaner over the surface to be cleaned, under the influence of the liquid under pressure flowing through the pressure passage.

2. A cleaner as claimed in claim 1 wherein two surface-engageable wheels mounted on a common axle are connected to be driven by the turbine, the drive train comprising a first pulley on an output shaft of the turbine, a second pulley on the common axle and a belt extending between the two pulleys.

3. A cleaner as claimed in claim 1 wherein at least one of the surface engageable wheels is a pivotable steering wheel mounted on an axle therefor, the at least one steering wheel, in use, being pivoted by actuation means driven by the turbine.

4. A cleaner as claimed in claim 3 wherein the actuation means comprises a belt and pulley arrangement connected to the turbine and a cam and follower arrangement, the cam being driven by the belt and pulley arrangement and the follower being connected to the axle of the pivotable steering wheel by at least one arm.

5. A cleaner as claimed in claim 1 comprising weight or ballast material in the body towards a bottom region thereof and buoyancy members towards a top region thereof.

6. A cleaner as claimed in claim 1 wherein a further branch passage extends between the pressure passage and an outlet from the further branch passage defined in the body, so that jets of liquid emitting through the outlet from the further branch passage may dislodge debris on the surface.

7. A cleaner as claimed in claim 1 comprising means for sweeping and/or scrubbing and/or brushing the surface to be cleaned mounted on the cleaner body.

8. A cleaner as claimed in claim 1 including a bumper comprising a ball mounted for rotation in a socket defined in the body, the ball extending outwardly beyond the periphery of the body to fend off submerged obstacles.

9. A cleaner as claimed in claim 1 comprising a hose bridge mounted at a top region of the body, flexible hoses for connecting the suction and pressure passages of the cleaner to the inlet and the outlet of the filtration system are connectable to the cleaner via the bridge.

10. A cleaner for a surface submerged in a liquid which is connectable to a filtration system including a pump and having an inlet and an outlet for the liquid, the cleaner comprising a body defining separate suction and pressure flow passages therethrough; the suction passage extending between a first inlet to the body and a first outlet from the body, the first outlet being connectable to an inlet of a filtration system; the pressure passage extending between a second inlet to the body and a second outlet from the body, the second inlet being connectable to an outlet of the filtration system; surface engageable wheels mounted on the body to support the body such that the inlet to the suction passage is spaced from the surface; and drive means comprising at least one of said surface-engageable wheels, a turbine extending at least partially into the pressure passage and a drive train drivingly connecting the turbine to the at least one surface-engageable wheels.

* * * * *